US008821127B1

(12) United States Patent
Knecht

(10) Patent No.: US 8,821,127 B1
(45) Date of Patent: Sep. 2, 2014

(54) BLADE LOCK FOR COMPRESSOR

(76) Inventor: Ken Knecht, Chugiak, AK (US)

( * ) Notice: Subject to any disclaimer, the term of this patent is extended or adjusted under 35 U.S.C. 154(b) by 714 days.

(21) Appl. No.: 13/091,864

(22) Filed: Apr. 21, 2011

(51) Int. Cl.
*F01D 5/14* (2006.01)
*F01D 5/02* (2006.01)
*F01D 5/32* (2006.01)

(52) U.S. Cl.
CPC ..... *F01D 5/021* (2013.01); *F01D 5/323* (2013.01)
USPC ..... 416/215; 416/216; 416/217; 416/219 R; 416/220 R; 416/248; 29/889.2; 29/889.3; 29/889.7

(58) Field of Classification Search
CPC ..... F01D 5/005; F01D 5/021; F01D 5/3015; F01D 5/303; F01D 5/323
USPC ..... 416/215, 216, 217, 219 R, 220 R, 248; 29/889.1, 889.2, 889.3, 889.7
See application file for complete search history.

(56) References Cited

U.S. PATENT DOCUMENTS

| | | | | |
|---|---|---|---|---|
| 4,417,854 | A * | 11/1983 | Cain et al. | 416/219 R |
| 4,802,824 | A * | 2/1989 | Gastebois et al. | 416/193 A |
| 5,350,279 | A * | 9/1994 | Prentice et al. | 416/220 R |
| 5,624,233 | A * | 4/1997 | King et al. | 416/219 R |
| 6,619,924 | B2 * | 9/2003 | Miller | 416/220 R |
| 7,972,113 | B1 * | 7/2011 | Davies | 416/214 A |
| 8,206,118 | B2 * | 6/2012 | Propheter-Hinckley et al. | 416/219 R |

* cited by examiner

*Primary Examiner* — Igor Kershteyn
(74) *Attorney, Agent, or Firm* — Christensen O'Connor Johnson Kindness PLLC

(57) ABSTRACT

A blade assembly for a groove of a wheel of rotating machinery is described. The blade assembly includes, a blade root having two longitudinal sides, a base, and a roof, wherein the profile of the longitudinal sides includes a rounded surface, a blade connected to the roof of the blade root, and one or more keys juxtaposed along each longitudinal side of the blade root, each key having an inboard side and an outboard side, wherein the profile of the inboard side of each key is configured to mate with the profile of the blade root. The blade assembly allows replacement of a compressor blade without the need for unstacking the rotor to gain access to the damaged blade.

19 Claims, 6 Drawing Sheets

BLADE LOCK FOR COMPRESSOR

BACKGROUND

Axial compressors have many applications in industry. An axial compressor is often a critical piece of machinery in many processes. Accordingly, it is paramount that the compressor be reliable and, when the need arises to repair a compressor, that the down time for repairs be kept to a minimum. Lost production due to equipment down time can be costly. An axial compressor usually has a split casing to allow access to the rotor. A conventional rotor for a compressor includes a plurality of wheels stacked axially on the rotor. The surface at the edge of the wheel is provided with airfoil-shaped blades. When a compressor wheel rotates, the airfoil-shaped blades compress the working fluid, such as a gas, from a lower pressure to a higher pressure. Industrial compressors can be extremely heavy machinery with correspondingly heavy wheels. Compressor blades can become damaged, chipped, or broken, which affects the performance of the compressor. Conventionally, to replace one or more compressor blades requires the top half of the split casing to be removed. The rotor is then dismounted together with all the wheels and taken to a machine shop, where the wheels can be unstacked. This conventionally had to be done to remove and replace a single blade.

Disclosed herein is a modified compressor blade and method of removing and replacing compressor blades, such that the procedure of removing the rotor and unstacking the compressor wheels can be avoided.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
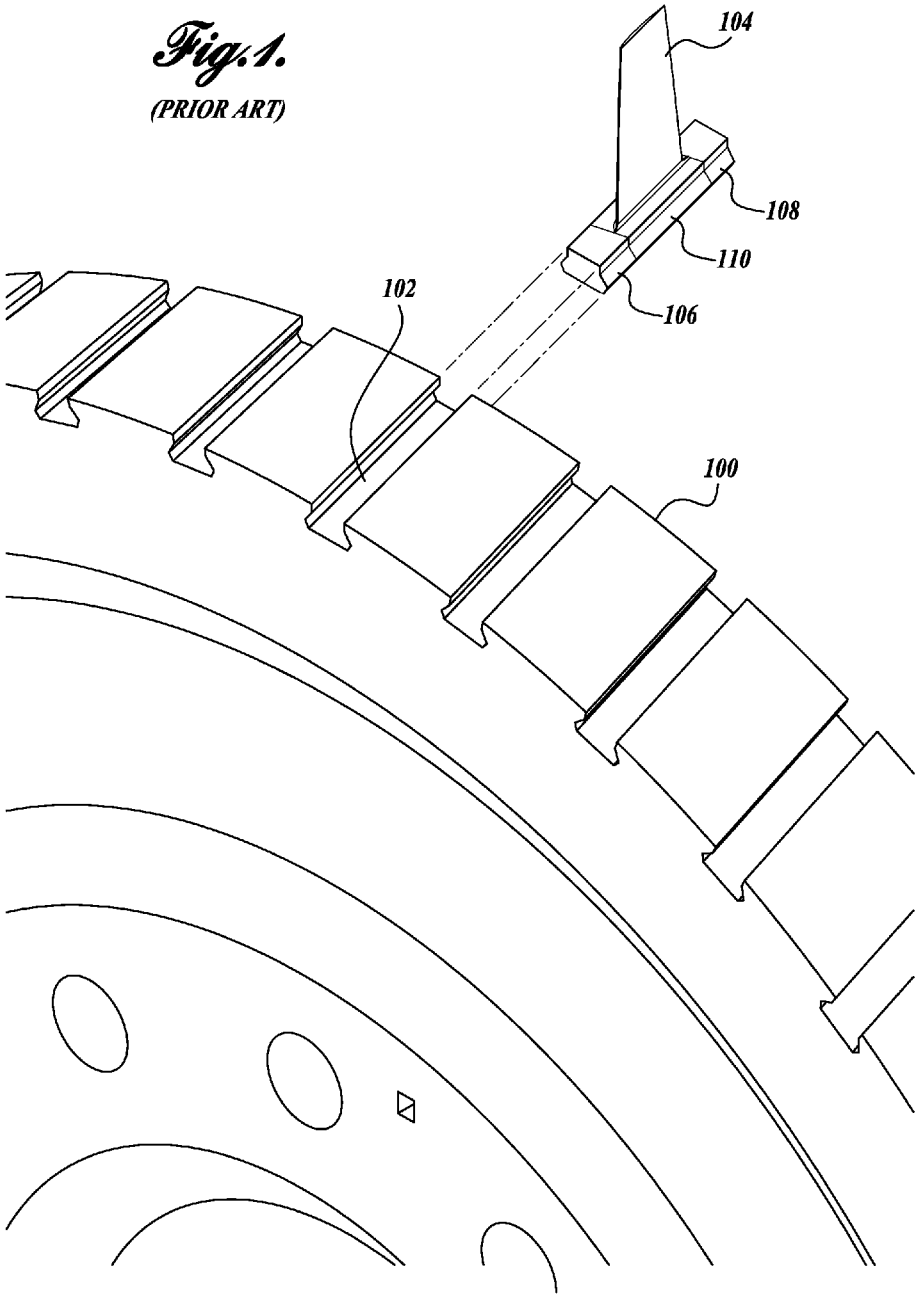
Fig. 1. (PRIOR ART)
FIG. 1 is a diagrammatical illustration showing a compressor wheel and placement of a single blade in the wheel.

Referring to FIG. 1, a conventional unstacked (off the rotor) compressor wheel 100 is illustrated. A blade 104 connected to a platform is in one single piece. The blade (platform) or root 110 is configured to fit within a groove 102 on the outermost radial surface of the wheel 100. The grooves 102 are usually at an angle with respect to the plane of the wheel 100. This is so that the blades can bite into the working gas. Generally, the root 110 includes a profile that is larger at the bottom than at the top. This is so that the root 110 can be wedged in the groove 102 to resist being pulled out due to centrifugal forces. The side configuration of the groove and of outboard sides of the blade root 110 can be any shape to meet the desired goal of resisting being pulled out. The root 110 slides into groove 102 and a forward spacer 106 and aft spacer 108 are provided forward and aft of the root 110 within the groove 102 to maintain the correct position of the blade within the groove 102.

Figure 2:
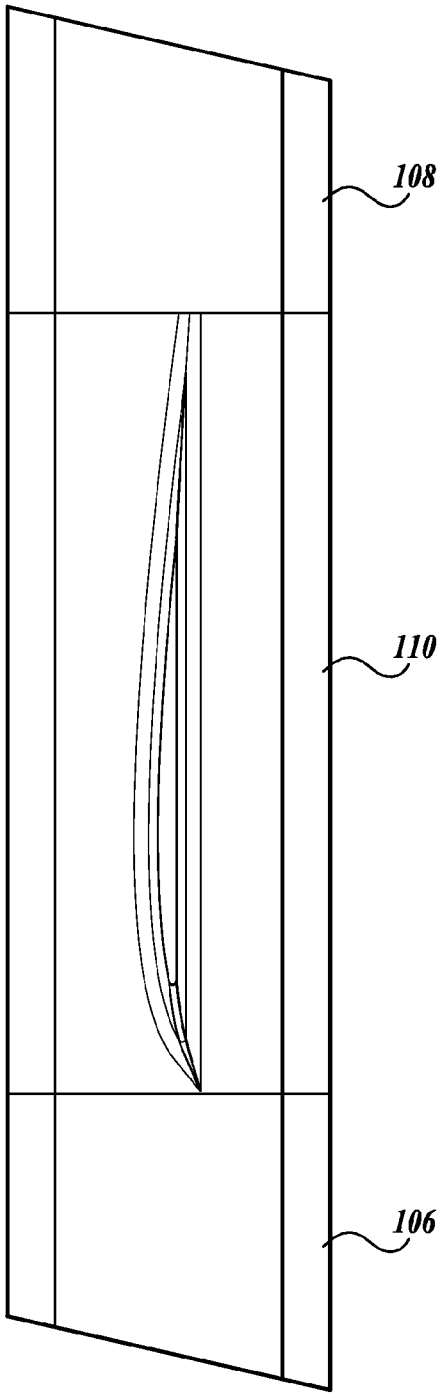
Fig.2. (PRIOR ART)
FIG. 2 is a diagrammatical illustration showing a top view of the conventional blade and forward and aft spacers for a compressor wheel.

FIG. 2 shows the top view of the blade root 110, and the forward spacer 106 and the aft spacer 108. The forward 106 and aft 108 spacers are angled because, as mentioned above, the blade root 110 is inserted at an angle on the wheel, and the ends of the spacers 106 and 108 are flush with the wheel front and rear sides. The size and angle of the compressor blades can vary from wheel to wheel. Also, the placement or distance axially on the wheel can vary from wheel to wheel. Accordingly, forward and aft spacers can vary in length, and in number from wheel to wheel.

Figure 3:
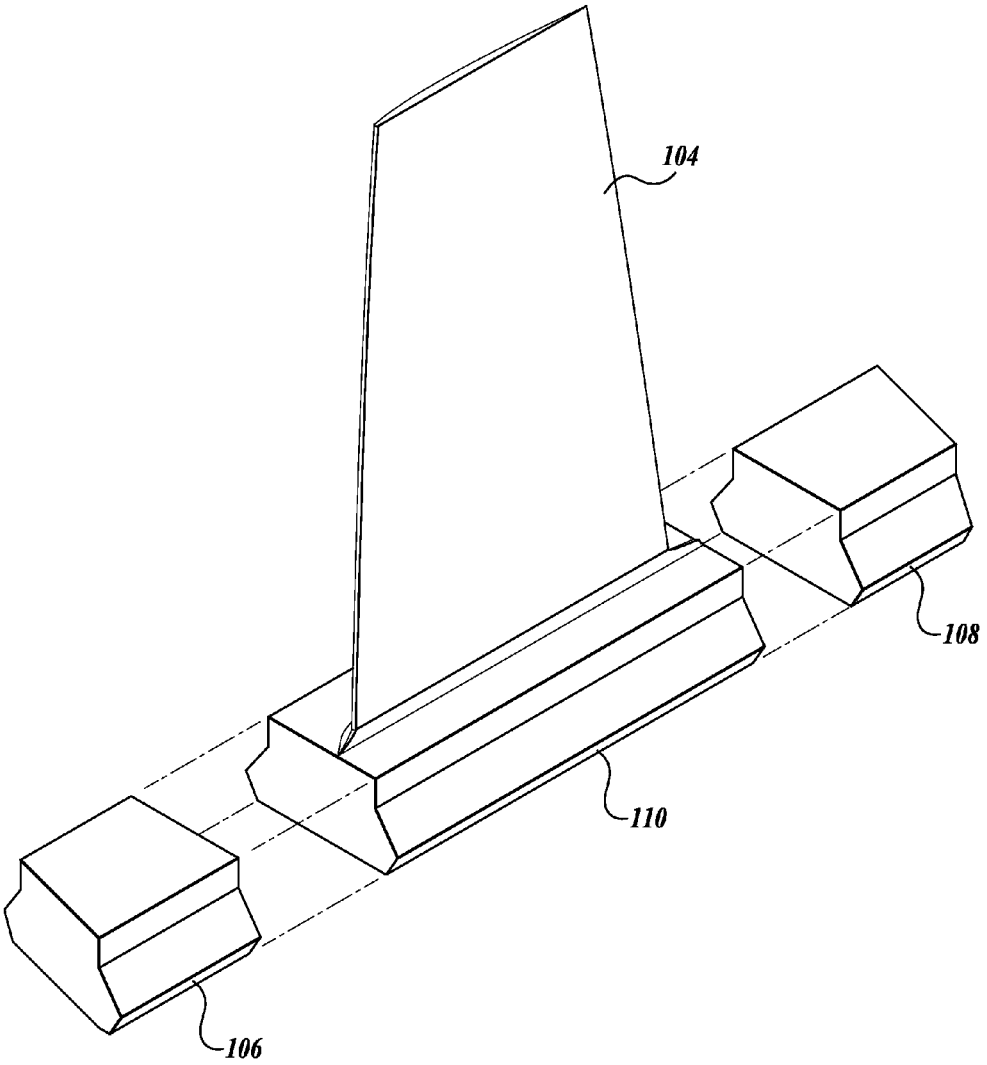
Fig.3. (PRIOR ART)
FIG. 3 is a diagrammatical illustration of a conventional blade and forward and aft spacers for a compressor wheel.

FIG. 3 shows the conventional three-part blade assembly, blade with root 110 having the blade 104 on the roof of the root 110, and the forward spacer 106 and the aft spacer 108 that are juxtaposed against longitudinal ends of the blade root 110.

The conventional method of replacing a damaged compressor blade is through the removal and unstacking of compressor wheels to allow enough clearance room either in front of or behind the blade being removed. This consumes vast amounts of time and money. The rotor is normally disassembled (unstacked) in order to remove and replace the compressor blades. In the unstacked condition, the blades can easily slide off the compressor wheels in the axial direction. In the assembled (stacked) condition, the wheel outside diameters do not allow axial clearance to remove the blades. If a blade requires replacement because of damage, the rotor will require unstacking in order to replace the blade or blades. This specialized work requires special tooling and well proven procedures. Mostly all rotors that require unstacking will be completed by the original manufacturer or special heavy turbine repair shops. The cost for this type of specialty work is very expensive and very time consuming. The rotor has to be removed from the machine usually offsite and moved to the selected repair facility. Accordingly, there is a need to replace blades without unstacking wheels. Disclosed herein is a blade assembly and method that accomplishes the replacement of blades without the need for unstacking wheels, and also without the need for removing the rotor from the casing.

Although a compressor wheel is used to illustrate embodiments of the invention, it is to be appreciated that the invention may be used with other rotating machinery having wheels, such as turbines, blowers, fans, and the like. Furthermore, any machinery with a rotor having at least one wheel, or a plurality of juxtaposed stacked wheels, whether rotating or stationary may be the subject of the invention.

Figure 4:
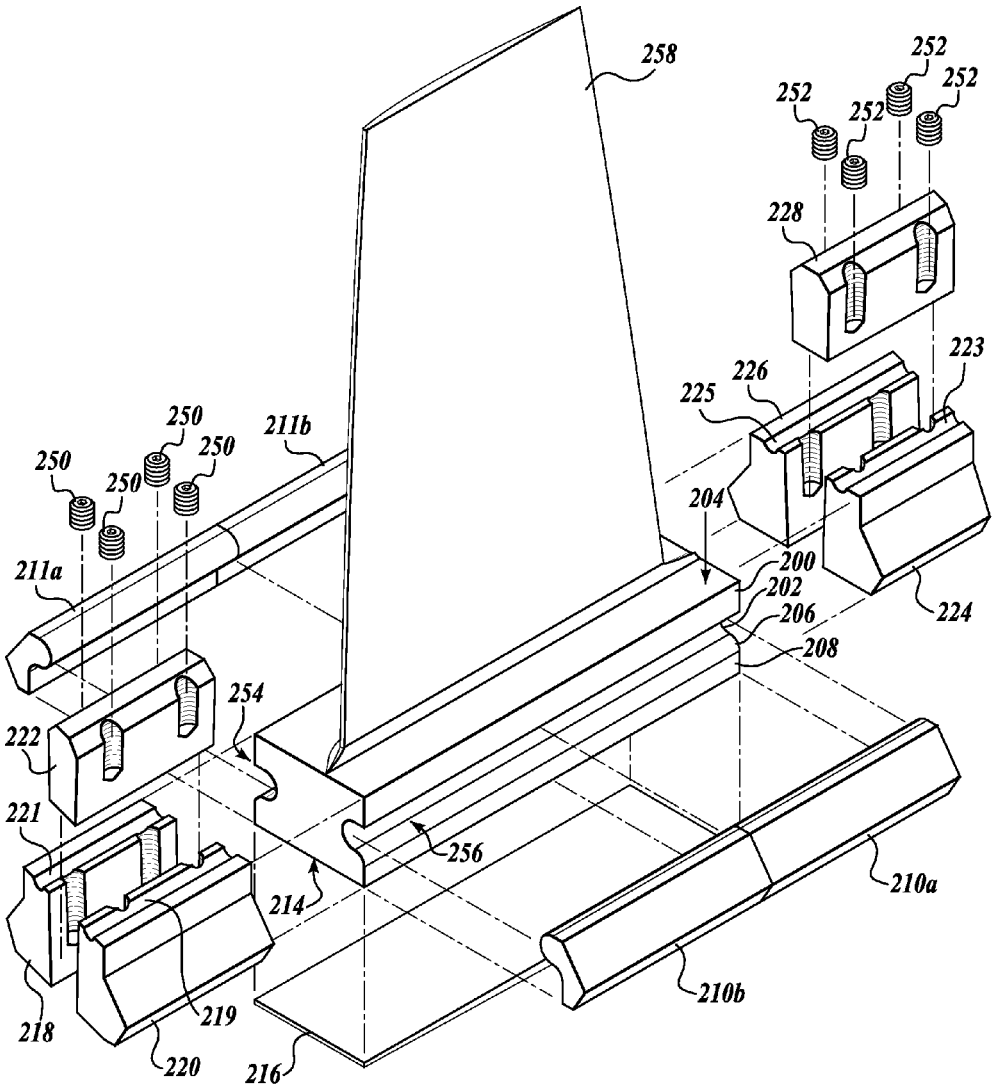
FIG. 4 is a diagrammatical illustration showing a modified blade and modified forward and aft spacers for a compressor wheel.

Referring to FIG. 4, a modified blade assembly to replace a conventional blade in a machine including a wheel, or a plurality of wheels, is illustrated. This modified blade assembly permits the replacement of blades, spacers, shims and bolts, without the need for unstacking the compressor wheels. This blade assembly can be used for the replacement of individual blades on an assembled rotor. The modified blade assembly illustrated in FIG. 4 can be completed onsite, and if needed, with the rotor installed in its casing. Access to the damaged blade may require the upper casing of the compressor stage to be removed. The targeted or damaged blade is first removed from the wheel by cutting off the blade equal to the outside diameter of the wheel. The root of the blade inside the groove of the wheel can be ground out using portable hand grinders or portable machining tools. The forward and aft one-piece spacers are also removed during this process to allow axial clearance for the new modified blade assembly illustrated in FIG. 4. The modified blade can be machined from a new blade. Alternatively, the modified blade can be machined from individual stock. All dimensions of the original unmodified blade may be incorporated into the modified blade assembly.

The major components of the blade assembly include, a blade root, one or more keys on a side of the blade root, and spacer assemblies forward and aft of the blade root. Shims, and grub screws may also be provided. The blade root 200 includes a first longitudinal side 256 and an opposite second longitudinal side 254. The blade root 200 has a base 214 and a roof 204 opposite from the base 214 connecting the sides along the length thereof. An airfoil-shaped blade 258 is connected to the roof 204 of the blade root 200. In one embodiment, the blade root 200 is modified by removing the material that extends beyond the profile of the roof 204 of the blade root 200 and then machining a longitudinal groove 202 along a longitudinal side approximately at the midpoint in height of the root 200. The profile of the groove 202 forms a 180 degree arc of a specific radius. The purpose of the groove is to provide a curved fillet to reduce concentration of stress to one particular location. The term "outer radius fillet" is used to describe the groove 202. The groove 202 is then connected to a rounded edge 206. The profile of the rounded edge 206 forms a 90 degree arc of a specific second radius. The term "inner radius fillet" is used to describe the rounded edge 206. The rounded edge 206 is followed by a straight edge 208 ending at the base of the blade root 200. A similar groove, rounded edge, and straight edge are machined on the opposite longitudinal side of the root 200.

A number of keys are juxtaposed and along the modified longitudinal sides of the blade root 200. In the illustrated embodiment, two keys 210*a* and 210*b* are shown on one longitudinal side 256 of the blade root 200, and two keys 211*a* and 211*b* are shown on the opposite longitudinal side 254. Each key will include an inboard side, which is the side facing the blade root 200, and an outboard side, which is the side facing away from the blade root 200 and toward the sides of the groove 102 in the wheel 100, when installed from the radial direction and then slid in the axial direction. The outboard sides of keys 210 and 211 include a matching angle profile of the rotor groove 102. It should be appreciated that the outboard profile of a key is the same as the original blade base/profile to match the groove in wheel. The specific configuration of the outboard sides of the keys and spacers of the FIGURES is merely to illustrate one embodiment of the invention. For example, the outboard profile of the keys can be rounded or a combination of straight planes with rounded edges. While in the illustrated embodiment two keys are shown per side, in other embodiments one or more keys can be used juxtaposed next to each other along the sides of the blade root 200 so that the total length of the keys when juxtaposed end to end is the same as the blade root 200. The number of keys will depend on the particular blade being modified and the amount of axial room that there is forward and aft of the blade. In one embodiment, a single key matching the length of the blade root 200 is provided. However, other embodiments may include more than one key per side on the blade root 200. When the modified blade root 200 and all modified keys are assembled, one piece at a time into the rotor groove the assembly can have the same width dimensions as the original blade, so as to fit within the groove 102 of the wheel.

Figure 5A:
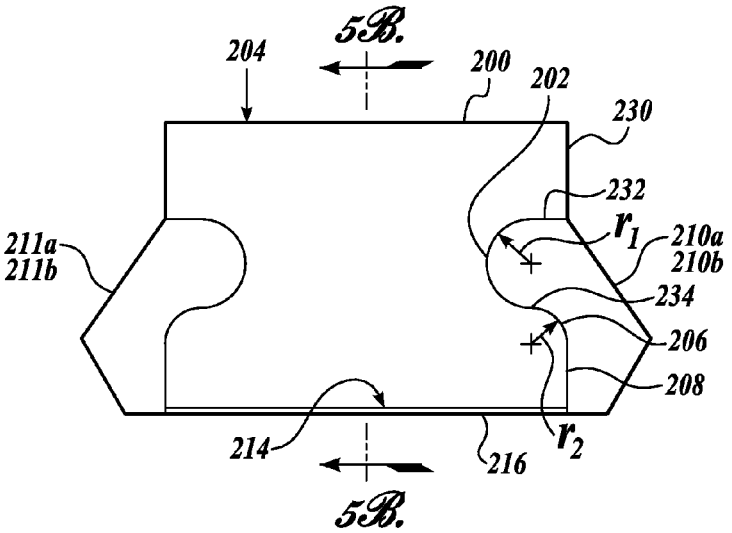
FIG. 5A is a diagrammatical illustration of the modified blade root showing the profile of the longitudinal sides.

The profile of the blade root 200 and keys 210 and 211, when assembled, is illustrated in FIG. 5A. The groove 202 and rounded edge 206 machined, or otherwise provided, on the sides of the blade root 200 comprise two fillet radii, $r_1$ and $r_2$. The fillet radius $r_2$ is an inner fillet radius because the center lies inside of the blade root 200. In one embodiment, the outer fillet radius can circumscribe 180 degrees of arc, and the inner fillet radius can circumscribe 90 degrees of arc. The centers of radii can be directly in line vertically with each other. The radii size may change depending on a stress analysis. In one embodiment, the entire profile of a longitudinal side of the blade root 200 includes, in order from the roof 204 to the base 214, a vertical land 230 connected to the roof 204, a horizontal land 232 connected from the vertical land 230, a 180 degree outer fillet radius, $r_1$, connected from the horizontal land 232, a 90 degree inner fillet radius, $r_2$, connected from the outer fillet radius, and a vertical land 208 connected from the inner fillet radius to the base 214. This profile can also be explained as a spline line, curve, or smooth profile. In other embodiments, the side profile may include a horizontal land 234 connected to one end of the fillet radius $r_1$ and the fillet radius $r_2$. In the illustrated embodiment, the land 234 length is essentially zero, as the arc circumscribed by $r_2$ immediately connects to the arc circumscribed by $r_1$.

As seen in FIG. 5A, the keys 210*a,b* and the keys 211*a,b* have inboard and outboard sides. The inboard sides of the keys are configured to mate with the profile of the blade root 200, as described above. The outboard sides of the keys can be configured to mate with any configuration of a groove provided in a wheel.

The radii $r_1$ and $r_2$ of the groove 202 and of the rounded edge 206 can vary from the blades of one wheel to blades of another wheel. To determine the suitable radii, a stress analysis can be performed using 2-D or 3-D modeling. For example, a suitable model can be used to measure stresses at modeled contact points along the blade root to key interface. Contact elements can be modeled to allow separation when two sections of the model try to separate under an applied load, but the model does not allow the two sections to overlap or penetrate each other when they are pushed together. The edges of a model can be constrained to simulate being mounted in a wheel attachment under an applied radial load that attempts to pull the blade root out of the wheel. Two parameters that can be used to judge the effectiveness of any configuration are: (1) the section average stresses across the minimum cross sections of the blade root and keys, and (2) peak fillet stresses in the blade root and keys. In the illustrated embodiment, for example, the groove 202 fillet, $r_1$, and the rounded edge 206 fillet, $r_2$, are geometric parameters that can be varied. The flat land 234 (shown in FIG. 5A as a land 234 of zero length) between the fillets varies with the two fillet radii and, in effect, can become a third parameter. To determine fillet radii, $r_1$ and $r_2$, various configurations of $r_1$ and $r_2$ can be stress modeled, and the geometric parameters that achieves the lower stresses can be determined. Such geometric parameters producing the lowest stresses can be incorporated into the sides of the blade root 200 and the keys 210*a, b* and 211*a, b*.

To ensure tight locking and to control the blade tip deflection of the modified blades, it is desirable to maintain the horizontal land 234 even if the land length is merely zero length or the point at which $r_1$ continues into $r_2$. For some embodiments, generally, larger fillet radii, $r_1$ and $r_2$, lead to reduced blade root and key fillet stress levels, and the desire to maintain the horizontal land 234, results in a configuration that maximizes the fillet radii, $r_1$ and $r_2$, and has no land width, i.e., land 234 of FIG. 5A becomes zero and is a point at which $r_1$ continues into $r_2$.

Figure 5B:
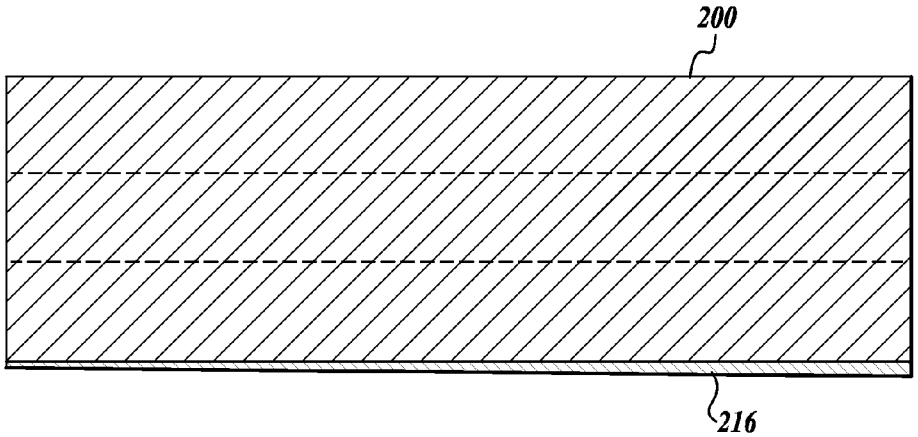
FIG. 5B is a diagrammatical illustration of a tapered shim.

Referring to FIG. 4 again, the base 214 of the blade root 200 includes a taper along the longitudinal direction, meaning that the distance from base 214 to roof 204 is greater at one longitudinal end of the blade root 200 as compared to the opposite longitudinal end. The reason for the taper will become apparent below. The tapered base 214 can be an additional machining process performed on the base 214 of the blade root 200. This tapered base 214 will provide radial clearance (i.e., clearance between the base 214 and the bottom surface of the groove 102 of the wheel 100) for the blade root 200 and keys to move in the axial direction in the groove 102. A corresponding tapered shim 216 is later used to hold the blade root 200 and keys 210*a, b* and 211*a, b* in the correct axial position in the groove 102. The thickness of the shim 216 can be determined for each blade. The shim 216 that has the same taper as the base 214 of the blade root 200 can be used at final assembly to tighten and lock the blade root 200 in its final position. The shim 216 shown in FIG. 5A has a width that matches the width of the base 214, so that the shim 216 does not extend beneath the keys 210*a,b* and 211*a,b*. FIG. 5B is provided to show the taper of the blade root 200 and shim 216. The top hidden line shown in the blade root 200 represents a flat horizontal land on the left side of the blade root 200 corresponding to the flat horizontal land 232 of the radius, $r_1$, on the right side of the blade root 200 seen in FIG. 5A, and the bottom hidden line represents a horizontal land on the left side of the blade root 200 corresponding to the horizontal land 234 where the radii $r_1$ and $r_2$ meet.

Referring to FIG. 4, the blade assembly includes a forward spacer assembly and an aft spacer assembly. The forward spacer assembly includes spacer halves 218 and 220 with the wedge 222 between the spacer halves 218 and 220. The aft spacer assembly includes spacer halves 224 and 226 with the wedge 228 between the spacer halves 224 and 220. Forward and aft spacers are modified by machining into two similar left and right parts (or halves) by removing material down the center of each spacer. The wedges 222 and 228 are used to spread the spacer halves so that the spacer assemblies are locked into the groove 102. In one embodiment, grub screws, such as 250, for the forward spacer assembly and grub screws 252 for the aft spacer assembly can be used in the final assembly for locking. The outboard sides of the spacer halves 218, 220, 222, and 224 are similar in shape to the outboard sides of the keys 210 and 211.

Figure 6:
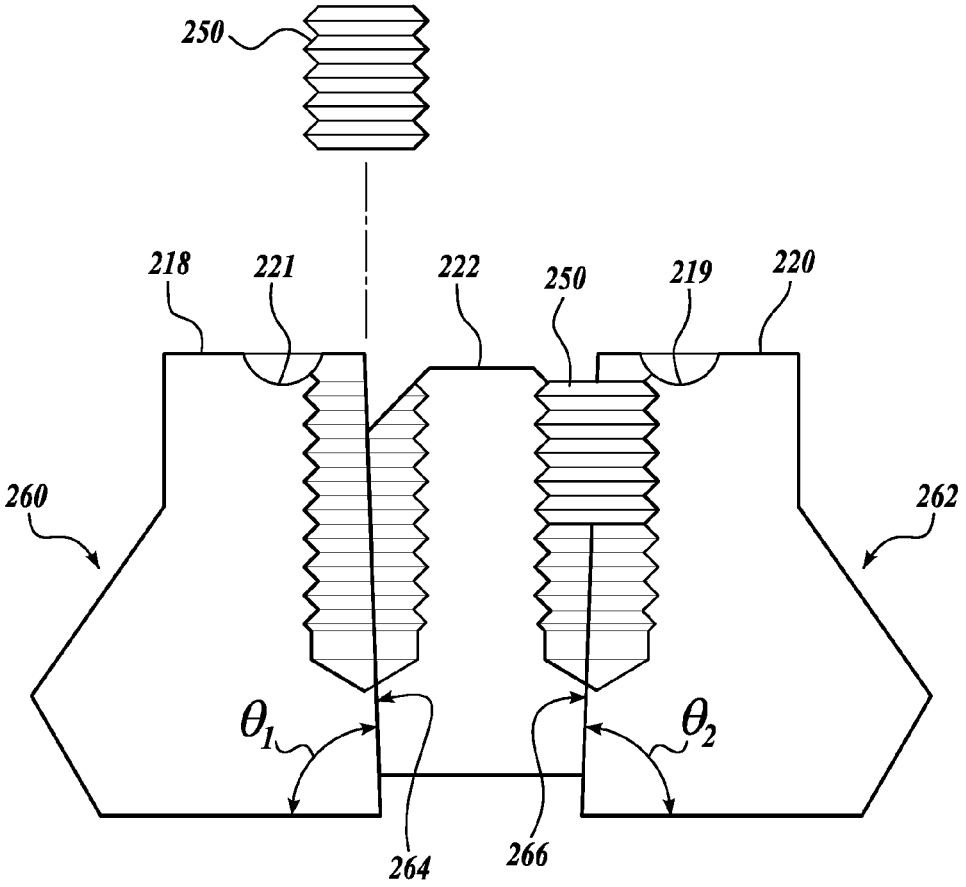
FIG. 6 is a diagrammatical illustration of a profile view of the modified spacers.

Referring to FIG. 6, the profile view of forward spacers 218 and 220 are shown with wedge 222 in the center thereof. The spacer half 218 includes an outboard side 260 and an inboard side 264. The spacer half 220 includes an outboard side 262 and an inboard side 266. It can be seen that the angle $\theta_1$ between the base of spacer half 218 and the inboard side 264 is an angle less than 90 degrees. It can also be seen that the angle $\theta_2$ between the base of spacer half 220 and the inboard side 266 is an angle less than 90 degrees. The same configuration may be applied to any spacer halves. The wedge of any two spacer halves, such as wedge 222, can have similar angled sides, wherein the angle that is less than 90 degrees is with respect to the upper surface of the wedge. The configuration described herein is used to apply an outward circumferential force when the wedge is driven between the spacer halves. The spacer halves 218 and 220 also include a groove 219 and 221, respectively, provided in the roof of the spacer halves 218 and 220. The grooves 219 and 221 are peened. The peening over (towards the wedge) of the grooves locks and prevents the wedge from moving outward, and the addition of one or more grub screws 250 locks the wedge to the spacer halves outward in the wheel groove 102.

Once the components of the modified blade assembly, including blade root, keys, spacer halves, shim, and wedges are produced according to the description above, the procedure for removing the old blade and replacing the new blade may be as follows.

The old blade and forward and aft spacers are removed from the groove in the wheel. The groove may be inspected and prior to installing the new modified blade assembly, the groove may be cleaned and deburred to make the groove free of residue and damage.

The blade root and keys are machined, or otherwise made, with the selected profile based on the computer modeling technique described above, for example. However, other methods for determining the profiles may be used, such as actual construction of different profiles and actual testing. The keys may be cut into equal lengths, such that the total length of keys on one side are equal to the blade root length. The number of keys on a side would depend on the particular compressor wheel and the amount of room available to install from the modified blade and keys from axial directions. One or more keys may be installed per side, and the minimum number of keys should be used. This is to be determined by installing the blade root 200 in the groove 102 and moving the blade root 200 forward and aft in the groove 102 to gain best access for key installation.

The modified blade root 200 is installed in the selected position from either forward or behind the wheel, and then the keys are installed in the suction side and pressure side of the blade by moving the blade axially. If moving the blade forward and aft is not required, the keys may be installed in any position. The blade and keys should move freely as a unit if a correct taper on the base of the blade root 200 has been machined. If axial freedom is not produced with the keys installed, the blade root may require additional clearance.

A temporary tapered shim may be installed to hold the blade root and the keys in the true axial position. Next, the forward and aft spacer halves are fit into position. The position of the blade and spacers is checked and adjusted as required. The final axial position of the blade root on the wheel may be marked on the wheel outside diameter.

The forward and aft spacers are removed temporarily, and the thickest end of the tapered shim is marked for reference. The temporary shim is removed from under the blade root, and the thickest part of the shim that was under the blade root, is measured. A final shim is dimensioned based on the temporary shim measurement. The final shim should be fitted slightly tighter than the temporary shim. For example, the thickness measurement of a temporary shim can be 0.045" inches. The final shim may be slightly thicker at 0.047 inches to achieve a final tight fit of the blade root in the wheel groove. The final shim could be from 0.001" to 0.005" inches thicker than the temporary shim. The additional thickness may be determined by the installer. At this final procedure, the shim would be located at the correct axial position that was determined during the temporary shim set up. At positioning the final shim, the blade/root with the keys (as a unit) would be driven up onto the tapered shim to get the required radial force needed to tighten the blade assembly. Of course, the farther that the blade and keys are drove in the axial direction up on the tapered shim, the tighter the blade becomes. Tightness would be determined by the installer. This is why the tapered shim is cut flush with the end of the blade. The final shim would normally be longer than required in order to get the correct or required blade tightness in the groove, giving the installer some adjustments. The tapered shim needs to be flush with the ends of the blade base/root for the forward and aft spacer to seat tight, no clearance between spacer and blade.

At completion, the blade should be tight with no blade rock or looseness. The protruding final shim is cut flush with the forward and aft axial ends of the blade root and keys. The final shim should have full contact with the full length of the blade root. The ends of the blade assembly must be flush on both forward and aft faces.

The previously fitted forward and aft spacer halves may be installed next. The wedge height is selected to drive between the spacer halves. The wedge should not bottom in the groove before spacer tightness is achieved against the groove, and the wedge upper surface should be below the spacer half outer diameter. See FIG. 6. This is needed for peening of the spacers to lock the wedge in position.

Next, holes can be drilled and tapped for grub screws to safely lock wedge and spacer halves in their final position. The screws are installed and staked to lock them in place.

Once assembled, the new blade may require tip grinding for correct tip clearance. This can be completed by hand grinding or tip grinding in the machine using portable machine tools.

If a full row of compressor blades have been replaced, the rotor may be required to be trim balanced at speed.

While illustrative embodiments have been illustrated and described, it will be appreciated that various changes can be made therein without departing from the spirit and scope of the invention.

The invention claimed is:

1. A blade assembly for a groove, comprising:

a blade root having two longitudinal sides, a base, and a roof, wherein the profile of the longitudinal sides includes a rounded surface;

a blade connected to the roof of the blade root;

one or more keys juxtaposed along each longitudinal side of the blade root, each key having an inboard side and an outboard side, wherein the profile of the inboard side of each key is configured to mate with the profile of the blade root; and a spacer assembly forward and aft of the blade root juxtaposed against longitudinal ends of the blade root, wherein each spacer assembly includes a first and a second spacer with a wedge between inboard sides of the first and second spacer.

2. The blade assembly of claim 1, wherein the profile of the longitudinal sides includes an outer radius fillet and an inner radius fillet.

3. The blade assembly of claim 1, wherein the outboard side of the keys is configured to match a profile of the groove.

4. The blade assembly of claim 1, wherein the base of the blade root is tapered along the longitudinal direction.

5. The blade assembly of claim 1, wherein the outer radius fillet is greater than the inner radius fillet.

6. The blade assembly of claim 1, wherein the outer radius fillet meets the inner radius fillet at a land having no length.

7. The blade assembly of claim 1, wherein the outboard side of the keys extends outward of a profile of the roof of the blade root.

8. The blade assembly of claim 1, further comprising a tapered shim juxtaposed beneath the base of the blade root.

9. The blade assembly of claim 1, wherein the outer radius fillet makes an arc of 180 degrees and the inner radius fillet makes an arc of 90 degrees.

10. The blade assembly of claim 1, wherein the profile of the blade root includes a smooth shaped geometry to reduce stress at the interface of the blade root and keys.

11. The blade assembly of claim 1, wherein the profile of a longitudinal side of the blade root includes, in order from the roof to the base, a vertical land from the roof, a horizontal land from the vertical land, a 180 degree outer fillet radius from the horizontal land, a 90 degree inner fillet radius from the outer fillet radius, and a vertical land from the inner fillet radius to the base.

12. The blade assembly of claim 1, wherein an outboard side of the first and second spacer is a shape similar to a shape of an outboard side of a key.

13. The blade assembly of claim 1, wherein the wedge height between a roof and base is less than a spacer height between a roof and base.

14. The blade assembly of claim 1, further comprising a compressor wheel, wherein the wheel comprises a groove in the radial edge of the wheel, and the blade root and keys are placed with the groove.

15. The blade assembly of claim 14, further comprising a spacer assembly forward and aft of the blade root, wherein the forward and after spacer assemblies are juxtaposed against longitudinal ends of the blade root, wherein each spacer assembly includes a first and a second spacer with a wedge between inboard sides of the first and second spacer.

16. A method for installing a blade in a wheel of a machine, comprising:

removing a blade from a groove of a wheel of a machine, wherein the machine comprises a plurality of wheels stacked in an axial position along a rotor, at least one wheel including a plurality of blades, each blade inserted into a groove placed around the periphery of the wheel;

preparing a modified blade, including a blade root having two longitudinal sides, a base, and a roof, wherein the profile of the longitudinal sides includes a rounded surface;

preparing one or more keys, each key having an inboard side and an outboard side, wherein the profile of the inboard side of each key is configured to mate with the profile of the blade root;

radially inserting the modified blade and then installing the keys from a radial direction then moving in a axial direction with one or more keys juxtaposed against each of the longitudinal sides of the modified blade within the groove of the removed blade; and juxtaposing a spacer assembly forward and aft of the blade root against longitudinal ends of the blade root, wherein each spacer assembly includes a first and a second spacer with a wedge between inboard sides of the first and second spacer.

17. The method of claim 16, wherein the profile of the longitudinal sides includes an outer radius fillet and an inner radius fillet.

18. The method of claim 16, further comprising placing a tapered shim beneath the base of the blade root.

19. The method of claim 18, further comprising tapping and drilling holes for screws to lock the wedge in the inserted tight position between the spacers halves, and peening the groove in spacer halves towards the wedge to prevent the wedge from moving radially outwards.

* * * * *